United States Patent [19]

James

[11] Patent Number: 4,656,679

[45] Date of Patent: Apr. 14, 1987

[54] LIFTING SLINGS

[75] Inventor: David R. James, Tirley, England

[73] Assignee: James Industries Limited, Gloucester, England

[21] Appl. No.: 777,319

[22] Filed: Sep. 18, 1985

[30] Foreign Application Priority Data

Sep. 28, 1984 [GB] United Kingdom ..... 8424527

[51] Int. Cl.[4] ..... A61G 7/08

[52] U.S. Cl. ..... 5/81 R; 5/83; 5/89; 289/1.2; 294/74; 441/84; 24/114.5

[58] Field of Search ..... 5/81 R, 81 B, 81 C, 5/82 B, 82 R, 83–89, 425, 427; 441/80, 84, 85; 294/74, 140; 289/1, 2, 1.5, 17, 18.1; 24/114.5; 52/434, 436

[56] References Cited

U.S. PATENT DOCUMENTS

| | | | |
|---|---|---|---|
| Re. 29,728 | 8/1978 | Franklin | 441/85 |
| 650,986 | 6/1900 | Omeyer | 441/80 |
| 1,328,832 | 1/1920 | Hanrath | 294/140 |
| 1,403,362 | 1/1922 | Walters | 441/84 |
| 2,722,696 | 11/1955 | Johnson | 441/84 |
| 3,277,502 | 10/1966 | Wauthier | 5/81 R |
| 3,458,878 | 8/1969 | Combs | 5/81 R |
| 3,597,774 | 8/1971 | Warren | 5/84 |
| 3,857,645 | 12/1974 | Klein | 289/1.5 |
| 3,914,825 | 10/1975 | Reynolds | 24/114.5 |
| 4,144,713 | 3/1979 | Clark et al. | 5/81 R |
| 4,510,633 | 4/1985 | Thorne | 5/81 R |

FOREIGN PATENT DOCUMENTS

| | | | |
|---|---|---|---|
| 997218 | 1/1952 | France | 5/82 B |

*Primary Examiner*—John E. Murtagh
*Assistant Examiner*—Andrew Joseph Rudy
*Attorney, Agent, or Firm*—Collard, Roe & Galgano

[57] ABSTRACT

A lifting sling has end fittings for attachment to an invalid lifting device. The sling is of filled tubular form and comprises an outer sleeve of generally circular cross-section and a resilient filling, the resilience of which tends to maintain the normal cross-sectional shape of the sleeve. End tails extend from the fittings for attachment to the lifting device, and the sleeve is a woven tubular fabric of synthetic textile material.

9 Claims, 5 Drawing Figures

LIFTING SLINGS

BACKGROUND OF THE INVENTION

1. Field of the Invention

The invention relates to lifting slings as used with invalid lifting devices. The invention also relates to sling/lifting device combinations.

2. Description of the Prior Art

The slings used with invalid lifting devices, particularly invalid hoists, are normally of web form and they have been used in a variety of shapes and sizes to suit lifting requirements and the lifting device employed. In my co-pending patent application Ser. No. 615,301, now abandoned, I have disclosed a lifting method and hoists therefor useable to raise an invalid from a seated to a substantially standing position, employing a lifting sling which passes beneath the arms and around the back of the invalid being lifted. The plain and padded web slings such as have previously been used with invalid hoists possess the disadvantage that they can result in considerable discomfort for the invalid when used with this new lifting method.

SUMMARY OF THE INVENTION

An object of the invention is to provide a sling construction which overcomes the foregoing disadvantage and also provides increased comfort when used in other lifting applications. A further object is to provide sling/hoist combinations advantageously employing such a sling.

According to the invention a lifting sling has end fittings for attachment to an invalid lifting device and is of filled tubular form, comprising an outer sleeve of generally circular cross-section and a resilient filling the resilience of which tends to maintain the normal cross-sectional shape of the outer sleeve.

Thus the invention provides a sling whch in use conforms to the contours of the patient while compressing radially around the back and beneath the arms to a generally elliptical cross-section with rounded upper and lower edges, which result in the sling being comfortable when passed beneath the arms and around the back of an invalid as in the lifting method referred to.

Preferably the outer sleeve is of textile material and it is desirably a woven tubular fabric of synthetic textile material. The use of a woven textile material for the sleeve has important advantages in terms of invalid comfort as such a material has the property of low expansibility under tension. Thus when in use with a sling curved around the back of the invalid the outside of the curved arc of the sling takes the tension during lifting and the inside of the curved arc, which contacts the invalid, remains untensioned and goes slack. Thus the contacting area of the sling loosely conforms to the shape of the invalid against the resilience of the filling and the invalid is cushioned in a very comfortable manner. In fact, the degree of comfort provided is comparable to that achieved with conventional manual lifting in which a human arm is passed around the back of an invalid with the arm muscle conforming to the body shape as a cushion over bone.

Preferably the end fittings of the sling maintain the normal circular cross-section of the sleeve at the ends thereof when the sleeve is tensioned in use. The filling of the sleeve may be provided by a stuffing of material such as KAPOK or a foamed plastic material, the latter conveniently being formed in situ. The end fittings are conveniently plastic moldings which may have apertures through which attachment cord tails extend, these cords being knotted on the inner sides of the fittings for the purpose of retention. The attachment tails have the important advantage that the effective length of the sling, that is the total length of the sling and the tails between the two sling attachment points on the lifting device, is readily adjustable to suit the size of the patient and the lifting procedure, and they also enable the sling to be length adjusted after it has been passed around the patient before lifting is commenced, as will be described hereinafter.

The projecting cord tails may be the two ends of a single cord which passes through the sling, the length of the cord between the retention knots being such that this length remains untensioned when the sling is in use so that it does not affect the comfort of the sling. This arrangement provides the safety feature that should the sling fail, as a result of either failure of the textile sleeve or detachment thereof from an end fitting, the invalid being lifted will still be securely supported by the cord.

In an alternative arrangement separate cords extend from the two end fittings with each cord doubled so that one end thereof can be secured to the lifting device and the other end pulled to tighten the sling around the invalid before it is secured to the hoist. This has the advantage that only half the effort is required to tighten the sling, and each cord may pass around a pulley or through a sheave arrangement on the corresponding end fitting.

The use of a sling with cord tails, which allows the effective length of the sling to be adjusted, has important advantages and is itself a novel concept. It enables the sling to be left permanently attached to the lifting device and adjusted in effective length in a simple manner, without being detached from the lifting device, either before or after positioning around the patient. Thus such a sling/lifting device combination can be usable by a partially disabled invalid, providing a degree of independence not provided by the conventional sling attachment using suspension chains which have to be hooked onto the lifting device, and which have to be detached and hooked on using different chain links in order to adjust the effective length.

Reliable and simple attachment of each end of the outer sleeve to the corresponding end fitting of the sleeve may employ two annular wire rings which surround the sleeve with the end of the latter folded back over the outer ring and threaded back through the inner ring. This requires that each end fitting has a formation, such as an outwardly facing shoulder, over which the inner ring cannot pass while both rings can be loosely threaded over the outer end of the end fitting. With such an arrangement the attachment of the sleeve is a simple manual operation and the fixing is self-retaining in the sense that the greater the tension applied to the sling the more firmly is the sleeve retained at the end fitting. In addition it avoids the stress on a sewn connection which would result if such a connection were to be used.

A sling in accordance with the invention is conveniently used with a lifting method and hoist device in which a single sling is passed beneath the arms and around the back of the invalid while the latter is seated with the lower legs in a substantially vertical position. Such lifting methods and hoists are disclosed in said application Ser. No. 615,301. A lifting arm arrangement to which the sling is attached with the invalid so positioned is pivoted upwardly to raise the invalid to a substantially standing position. The use of the present sling with end attachment tails facilitates initial tensioning of the sling before lifting commences thereby achieving the maximum lift for a given angular movement of the lifting arm arrangement which is typically of the order of 60°. It also has the advantage that there is no requirement to adjust the range or reach of the hoist, all conditions of patient size and height being accommodated by adjustment of the effective sling length. The lifting arms may have end pulleys or guides for the cord tails of a sling in accordance with the present invention, and the latter may be adjustable secured by jamb cleats.

In addition to being advantageously used with a hoist device to raise an invalid from a seated to a substantially standing position, the sling of the invention may with corresponding advantages by used in a sling/hoist combination usable to raise an invalid from a lying down position. Such a combination may operate with a two-stage lift; the first stage of which raises the patient from a lying-down position to a seated position, on a bed for example, and the second stage of which completes the lifting to a substantially standing position.

In a particularly advantageous arrangement the lifting arm arrangement of the hoist or an outer end section thereof, presenting spaced arms to which the lifting tails are attached, is spring loaded upwardly away from its operative lifting position at the commencement of lift. Such an arrangement of the lifting arm arrangement precludes any possibility of the outer arm portions inadvertently striking and injuring the invalid to be lifted during initial positioning of the hoist, and the pre-tensioning of the sling before lifting is commenced overcomes the spring loading of the outer arm section and brings it down to said operative lifting position so that lifting can commence under the control of the lifting mechanism.

Such a hoist arrangement, in which spaced arms to which the lifting sling is attached are in the rest position spring loaded upwardly away from the patient's head and the initial lifting position, is in a preferred embodiment achieved by constructing the arm arrangement with inner and outer arm portions which are articulated with a degree of angular lost motion which allows the spring loaded movement of the outer portion to said rest position and which before lifting commences is taken up against the spring loading by pre-tensioning of the sling. It will be appreciated that the angular lost motion and the associated spring loading can be provided anywhere between an input member which controls lifting movement of the hoist and outer end of the lifting arm arrangement. Thus, for example, the arm arrangement may be a unitary pivotal construction with the lost motion build into the lifting mechanism.

DESCRIPTION OF PREFERRED EMBODIMENTS

Figure 1:
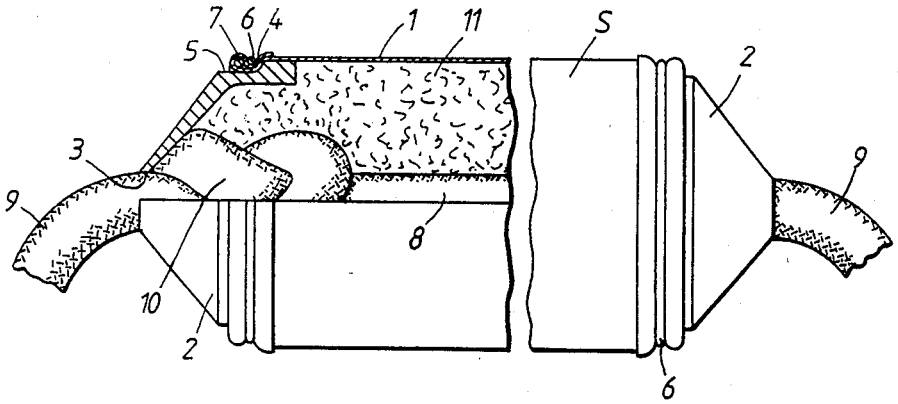
FIG. 1 is a side view of a sling in accordance with the invention, partly sectioned.

The sling S is of stuffed tubular form comprising a woven textile fabric sleeve 1 of a normal circular cross-section attached to identical end fittings 2. The sleeve 1 may be of synthetic plastic material such as nylon or Terylene, and the end fittings 2 are annular plastic moulding with central through bores such as 3. The fittings 2 are molded with an outwardly facing shouder 4 and an adjoining cylindrical peripheral surface 5. The sleeve 1 is secured to each end fitting 2 by two similar annular wire rings 6 and 7 which surround the sleeve 1 and the peripheral surface 5. Both rings 6 and 7 fit loosely over the surface 5, but cannot pass over the shoulder 4. Each end of the sleeve 1, as shown in the sectioned portion of FIG. 1, passes through the corresponding rings 6 and 7, is folded back around the ring 7 and passed back through the ring 6.

The illustrated attachment of the sleeve 1 provides a reliable fixing which is easily performed manually without the use of tools and which is self-retaining. Increase in the tensioning force applied to the sleeve 1 results in firmer retention with each end of the sleeve 1 being more firmly gripped between rings 6 and 7 against the shoulder 4. An attachment cord 8 of the sling which passes through the bores 3 and extends through the sleeve 1 provides projecting end tails 9 for attachment to the lifting hoist. The cord 8 has two knots such as 10 which respectively retain the tails 9 relative to the end fittings 2 as shown in FIG. 1.

The cord 8 extends loosely within the sleeve 1 between the knots 10 so that it does not come under tension when the sling is in use, and the sleeve 1 has a resilient filling 11. The filling 11 may be a material such as KAPOK or a foamed plastic material such as polyurethane. The latter when used may be foamed in situ and injected through one of the bores 3 around the cord 8, with the other bore 3 providing a bleed aperture indicative of complete filling.

Figure 2:
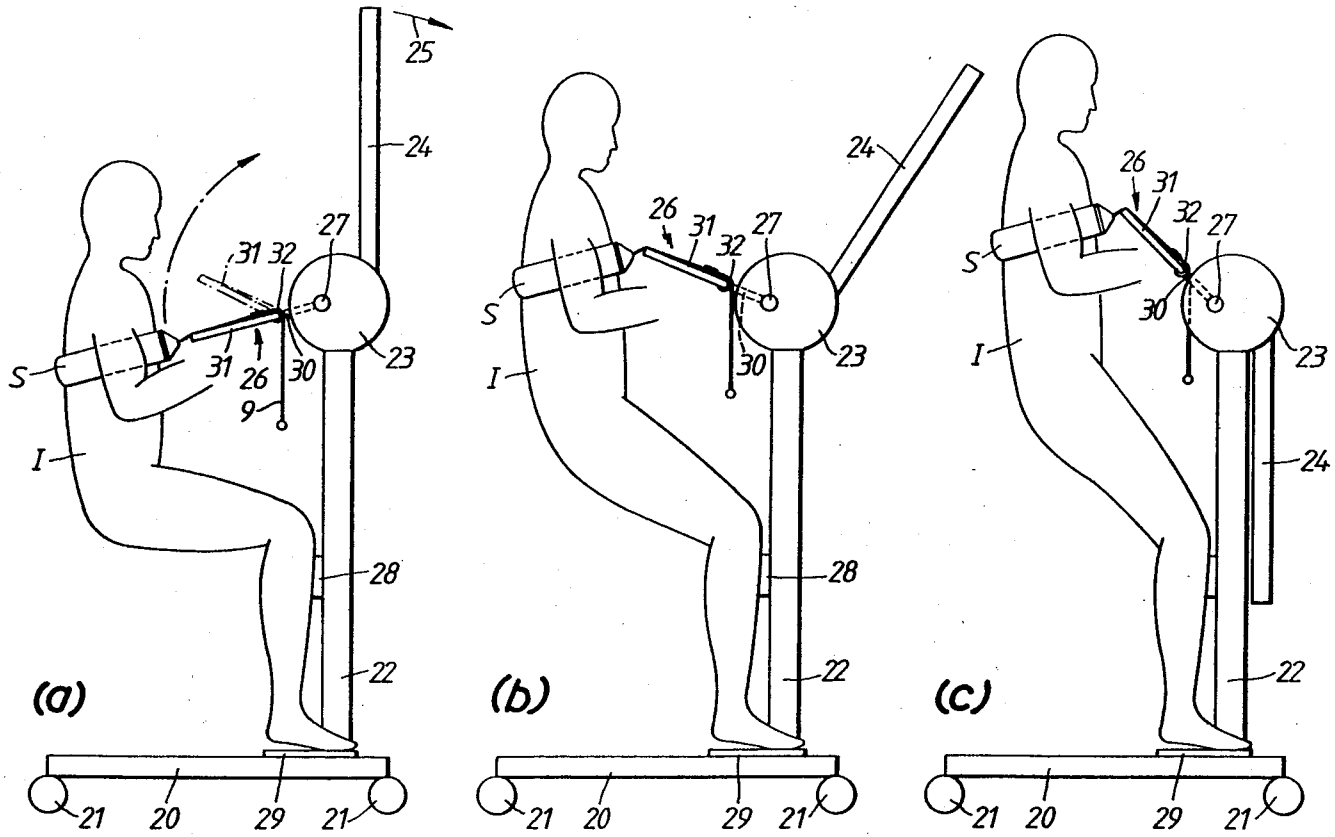
FIG. 2 diagramatically illustrates the combination of the illustrated sling and a hoist arrangement, and the lifting method employed therewith.

FIG. 2 diagramatically illustrates a preferred invalid hoist arrangement utilizing the sling of FIG. 1 and the lifting method employed therewith. The hoist comprises a mobile chassis 20 with castors 21 and an upstanding column 22 supported on the chassis 20. A lifting mechanism 23 mounted at the upper end of the column 22 is manually operated by means of an operating lever 24 which, during a full lifting movement, is moved from the vertical upwardly projecting position illustrated in FIG. 2(*a*) through an angle of substantially 180° in the direction of the arrow 25. A lifting arm arrangement 26 coupled to the mechanism 23 projects over the chassis 20 and during the lifting movement pivots about a horizontal axis at 27 from the position shown in FIG. 2(*a*) through an angle of about 60° to the fully-raised position shown in FIG. 2(*c*).

To lift the seated invalid 1 the hoist is initially brought up to the latter as shown in FIG. 2(*a*) so that knee abutment means 28 on the column 22 locate against the knees of the invalid 1, the feet of the latter then being placed on a footrest 29 on the chassis 20. As shown the lower legs of the invalid are now substantially vertical. The radius of arcuate movement of the ends of the arms 26 approximates to the average length of the human thigh bone, typically being of the order of 43 cm.

With the hoist located as just described, the support sling S attached to the arms 26 is passed over the head and around the back of the invalid 1 below the arm pits and the projecting tails 9 with the sling S attached to the arm arrangement 26. The arm arrangement 26 comprises an inner arm section 30, and an outer arm section comprising two spaced arms 31 and which pivots relative to the inner arm section 30 about a horizontal axis 32. The arms 31 are spring loaded upwardly about the pivot axis 32 to the free position shown in broken lines in FIG. 2(*a*). Pre-tensioning of the sling S by pulling on the tails 9 moves the arms 31 downwardly against the spring loading to the limit of their joint pivotal movement relative to the arm section 30 shown in full lines in FIG. 2(*a*), when the outer arms 31 are effectively an extension of the inner arm section 30. The attachment and securing of the tails 9 to the lifting arms 26 is described hereinafter with particular reference to FIG. 3.

With the sling S pre-tensioned as described the operating lever 24 is pulled down to raise the lifting arms 26 and with them the invalid 1 to the substantially standing position shown as FIG. 2(*c*). An intermediate position of the invalid 1, at the half-way point in the raising movement, is shown in FIG. 2(*b*).

Figure 3:
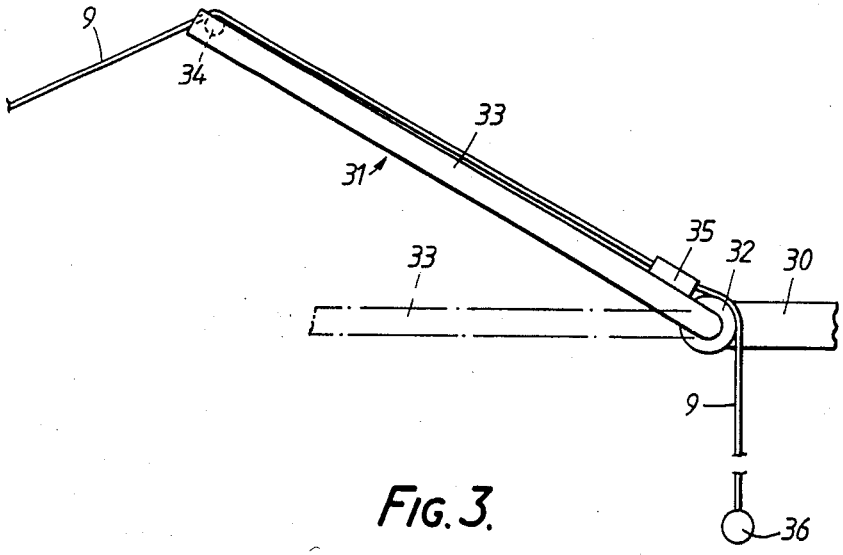
FIG. 3 illustrates the attachment of the sling to the hoist arrangement of FIG. 2.

FIG. 3 illustrates the arm arrangement 26 and the manner of attachment and securing of the sling tails 9. The inner arm section 30 projects centrally from the pivot axis 27 and is coupled to the lifting mechanism 23, and the outer arm section 33 comprises the two laterally spaced arms 31 to which the sling tails 9 are respectively attached. The spacing of the arms 31 approximates to the shoulder width of a typical invalid, and FIG. 3 illustrates the outer arm section 33 in said free position to which it is moved by said spring loading about the axis 32. A freely rotatable guide pulley 34 is mounted at the outer end of each arm 31, and adjacent the inner end of each arm 31 a jamb cleat 35 is mounted thereon. Each tail 9 terminates in a knob 36 by which it can be pulled to pre-tension the sling S, and by which it is held captive with respect to the corresponding cleat 35 which at the outer end has a guide bore through which the tail passes.

With the hoist initially positioned as has been described and the sling S slackened off the latter is passed around the invalid 1 below the arm pits thereof. The sling S is now pre-tensioned by pulling on the knobs 36, and this pre-tensioning moves the arm portion 33 against its spring loading to take up the angular lost motion with the arms 31 in the initial lifting position illustrated in broken lines in FIG. 3. The sling tails 9 are engaged with the jambing formations of the cleats 35 so that the pre-tensioned sling S is securely attached to the lifting arms 31 and the lifting movement can commence.

Figure 4:
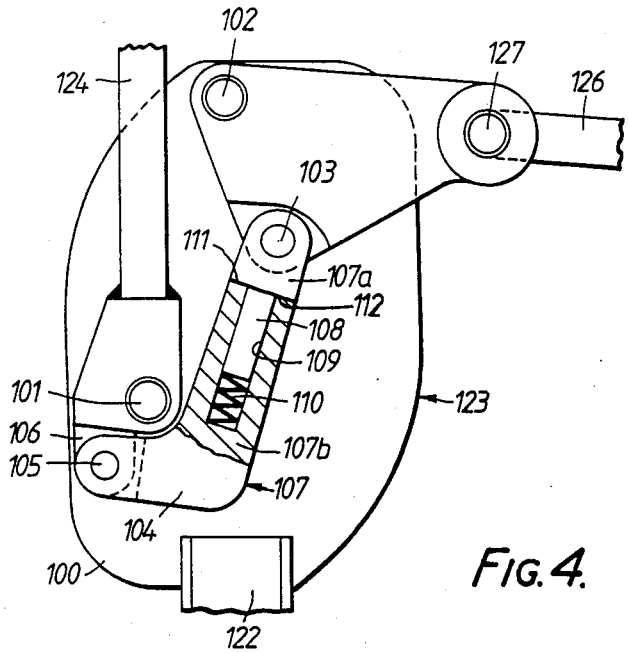
FIGS. 4 and 5 illustrate a modified hoist construction.
Figure 5:
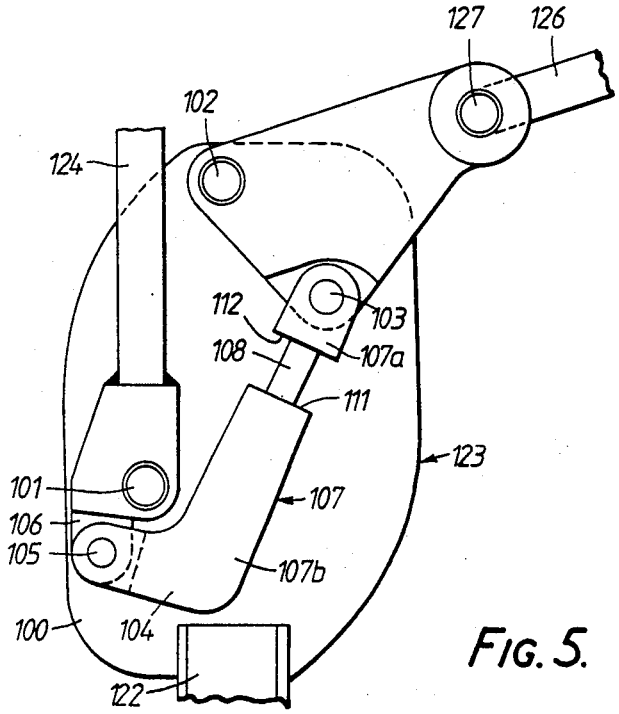

FIGS. 4 and 5 illustrate a modified lifting mechanism 123 which incorporates the angular lost motion and associated spring loading which, in the hoist arrangement of FIG. 2, is achieved by use of an articulated lifting arm with the two arm sections 30 and 33 which have been described. A pivotal linkage couples the operating lever 124 to the lifting arm arrangement 126 which is now of unitary constructions, the inner end of the arm arrangement being illustrated in the initial lifting position in FIG. 4 and in the free resting position, to which it is urged by the spring loading, in FIG. 5. The linkage of the mechanism is mounted and shrouded between two spaced cheek plates 100 and the operating lever 124 pivots on a pivot pin 101 fixed between the cheek plates 100, and the unitary lifting arm arrangement 126 pivots on a pivot pin 102 similarly fixed between the plates 100. At its inner end the arm 126 is of generally triangular shape with the pivot 102 adjacent an inner upper apex thereof, and adjacent a lower apex the arm is pivotally attached at 103 to the upper end of a dog-leg link 104. The other end of the link 104 is pivoted at 105 to a protruberence 106 on the lever 124. As so far described the lifting mechanism is identical with the mechanism 23 of FIG. 2, the present modification being concerned with the link 104.

As shown in FIGS. 4 and 5 the upper limb 107 of the link 104 is formed in two relatively telescopic parts. An upper part 107*a* has a projecting stem 108 slidable in a longitudinal bore 109 in the lower part 107*b* of the limb 107. A compression spring 110 in the bore 109 urges the two parts 107*a* and 107*b* apart to the limb-extended position illustrated in FIG. 5 which provides said rest position of the arm arrangement 126. The initial pre-tensioning of the sling 5 takes up the angular lost motion of the modified arrangement and compresses the limb 107 to its minimum length shown in FIG. 4 and defined by the engagement of abutment faces on the limb parts 107*a* and 107*b* at 111 and 112. This defines the initial lifting position of the arm 126.

It is very desirable that a hoist used as has been described with a sling in accordance with the invention should have hand grips which can be held by the invalid while being lifted and supported by the sling. Among other advantages such hand grips contribute to the comfort provided by the sling. In the hoist of FIGS. 4 and 5 such laterally extending hand grips are shown in end view at 127 in these figures. Typical dimensions for the sling S, given by way of example only, are a diameter of 6.5 cm and a length of 93 cm between the attachment rings 6.

I claim:

1. An invalid lifting sling of filled tubular form comprising:

an outer tubular elongated sleeve of generally circular cross-section containing a naturally resilient filling, said sleeve dimensioned to fit substantially around a torso of an invalid;

a pair of end fittings each firmly secured to an opposite end of said sleeve and which comprise plastic moldings having apertures; and attachment cord tails which extend through said apertures and attachable to an invalid device such that an invalid may be lifted with the sling by passing the sling around the back and below the armpits of the invalid, with said sling tending to maintain its generally circular cross-section due to the natural resilience of the filling, and said end fittings directly transferring lifting forces to said sleeve during lifting.

2. A sling according to claim 1, wherein said moldings have an inner side and wherein each of said attachment cord tails includes a knot on the inner sides of said moldings for retention purposes.

3. A sling according to claim 2, wherein a single cord having two ends passes through the sling with each of said ends serving as an attachment cord tail, said cord having a section length between the retention knots such that said section length remains untensioned when the sling is in use.

4. An invalid lifting sling of filled tubular form comprising:

an outer tubular elongated sleeve of generally circular cross-section containing a naturally resilient filling, said sleeve dimensioned to fit substantially around a torso of an invalid; and a pair of end fittings comprising plastic moldings each firmly secured to an opposite end of said sleeve and which maintain the circular cross-section of said sleeve at the ends thereof when the sleeve is under tension in use, with said fittings attachable to an invalid lifting device such that an invalid may be lifted with the sling by passing the sling around the back and below the armpits of the invalid, with said sling tending to maintain its generally circular cross-section due to the natural resilience of the filling, and said end fittings directly transferring lifting forces to said sleeve during lifting;

each end of outer sleeve being secured to the corresponding moulding of said end fittings by two axially outer and inner annular wire rings which surround said sleeve, with the corresponding end of said sleeve folded back over said outer ring and threaded back through said inner ring, each end fitting having a formation over which said inner ring cannot pass while both said rings can be loosely threaded over an outer end of the corresponding end fitting during assembly.

5. A sling according to claim 4, wherein said formation of each said molding comprises an outwardly facing shoulder, and said inner and outer rings are identical.

6. The combination of an invalid lifting sling of filled tubular form and an invalid hoist device operative to raise an invalid from a seated to a substantially standing position with said sling extending around the back and under the armpits of the invalid, said lifting sling comprising:

an outer tubular elongated sleeve of generally circular cross-section containing a naturally resilient filling, said sleeve dimensioned to fit substantially around a torso of an invalid; and a pair of end fittings each firmly secured to an opposite end of said sleeve, with said fittings attachable to an invalid lifting device such that an invalid may be lifted with the sling by passing the sling around the back and below the armpits of the invalid, with said sling tending to maintain its generally circular cross-section due to the natural resilience of the filling, and said end fittings directly transferring lifting force to said sleeve during lifting; and said hoist device comprising an upstanding column and a lifting arm arrangement projecting from said upstanding column and presenting laterally spaced arms with end attachment points for attachment of said sling, during lifting movement said attachment points traversing an arcuate path.

7. A combination according to claim 6, wherein said lifting arm arrangement is such that said lifting arms are spring loaded upwardly from the operative lifting position.

8. The combination of claim 7, wherein the sling has end attachment tails which allow initial tensioning of the sling before lifting of the invalid has commenced, and each lifting arm of the hoist has an end pulley or guide associated with a corresponding cord tail and also having securing means for securing said corresponding cord tail after the sling has been tensioned.

9. A combination according to claim 8, wherein said securing means comprise a jamb cleat on each lifting arm.

* * * * *